US006597120B1

(12) United States Patent
Schemerhorn et al.

(10) Patent No.: US 6,597,120 B1
(45) Date of Patent: Jul. 22, 2003

(54) FLAT-PANEL DISPLAY WITH CONTROLLED SUSTAINING ELECTRODES

(75) Inventors: Jerry D. Schemerhorn, Perrysburg, OH (US); Edward Anderson, Northwood, OH (US); Jae Sung Kim, Kumi (KR); Oleksandr Shvydky, Toledo, OH (US)

(73) Assignee: LG Electronics Inc., Seoul (KR)

( * ) Notice: Subject to any disclaimer, the term of this patent is extended or adjusted under 35 U.S.C. 154(b) by 527 days.

(21) Appl. No.: 09/629,118

(22) Filed: Jul. 31, 2000

Related U.S. Application Data

(63) Continuation-in-part of application No. 09/376,130, filed on Aug. 17, 1999.
(60) Provisional application No. 60/168,469, filed on Dec. 1, 1999.

(51) Int. Cl.[7] ..... G09G 3/10; H01J 17/49
(52) U.S. Cl. ..... 315/169.3; 313/586
(58) Field of Search ..... 313/581, 582, 313/583, 584, 585, 586; 315/169.1, 169.2, 169.3, 169.4

(56) References Cited

U.S. PATENT DOCUMENTS

| | | | | |
|---|---|---|---|---|
| 3,499,167 | A | 3/1970 | Baker et al. | 345/71 |
| 3,559,190 | A | 1/1971 | Bitzer et al. | 365/116 |
| 3,755,027 | A | 8/1973 | Gilsing | 156/67 |
| 3,942,061 | A | 3/1976 | van Esdonk et al. | 313/188 |
| 4,198,585 | A | 4/1980 | Yamashita et al. | 313/218 |
| 4,494,038 | A | 1/1985 | Wedding et al. | 313/188 |
| 4,629,942 | A | 12/1986 | Horio et al. | 315/169.4 |
| 4,638,218 | A | 1/1987 | Shinoda et al. | 313/169.4 |
| 4,723,093 | A | 2/1988 | Nolan | 313/201 |
| 4,737,687 | A | 4/1988 | Shinoda et al. | 315/169.4 |
| 5,086,297 | A | 2/1992 | Miyake et al. | 340/759 |
| 5,144,200 | A | 9/1992 | Kim | 313/584 |
| 5,164,633 | A | 11/1992 | Kim et al. | 313/581 |
| 5,525,862 | A | 6/1996 | Miyazaki | 313/582 |
| 5,541,479 | A | 7/1996 | Nagakubo | 313/586 |
| 5,634,836 | A | 6/1997 | Lepselter | 445/24 |
| 5,661,500 | A | 8/1997 | Shinoda et al. | 345/60 |
| 5,674,553 | A | 10/1997 | Shinoda et al. | 427/68 |
| 5,723,945 | A | 3/1998 | Schermerhorn | 313/581 |
| 5,757,131 | A | 5/1998 | Tsuchiya | 375/582 |
| 6,184,849 | B1 | 2/2001 | Stoller | 345/72 |
| 6,448,946 | B1 | 9/2002 | Anderson et al. | 345/60 |
| 6,459,201 | B1 | 10/2002 | Schermerhorn et al. | 313/586 |

FOREIGN PATENT DOCUMENTS

| | | |
|---|---|---|
| JP | 55-179962 | 6/1982 |
| JP | 58-153545 | 3/1985 |
| JP | 2671870 | 7/1997 |
| JP | 10-333636 | 12/1998 |
| JP | 10-038688 | 8/1999 |
| JP | 10-069949 | 10/1999 |

*Primary Examiner*—Don Wong
*Assistant Examiner*—Minh D A
(74) *Attorney, Agent, or Firm*—MacMillan, Sobanski & Todd, LLC

(57) ABSTRACT

A plasma flat-panel display comprising a hermetically sealed gas filled enclosure. The enclosure includes a top glass substrate having a plurality of parallel sustaining electrode pairs deposited upon an interior surface thereof and at least one auxiliary electrode associated with each pair of sustaining electrodes deposited upon the interior surface between the associated sustaining electrodes. The enclosure also includes a thin dielectric film covering the sustaining and auxiliary electrodes and a bottom glass substrate separated from the top glass substrate. The bottom substrate includes a plurality of alternating barrier ribs and microgrooves. An address electrode is associated with each microgroove and a phosphor is deposited over a portion of each address electrode. A first voltage is applied to the auxiliary electrode to initiate a discharge between the auxiliary electrode and a sustaining electrode. A second voltage, that is greater than the first voltage is applied to the sustaining electrodes and causes the discharge to extend between the sustaining electrodes.

32 Claims, 15 Drawing Sheets

FLAT-PANEL DISPLAY WITH CONTROLLED SUSTAINING ELECTRODES

CROSS REFERENCE TO RELATED APPLICATIONS

This application is a Continuation-in-part of U.S. patent application Ser. No. 09/376,130, filed Aug. 17, 1999, and claims the benefit of U.S. Provisional Application No. 60/168,469, filed Dec. 1, 1999.

FIELD OF INVENTION

This invention relates in general to a flat-panel display and in particular to an improved structure for a full color, high resolution capable flat-panel display which operates at a high efficiency.

BACKGROUND OF THE INVENTION

A flat-panel display is an electronic display in which a large orthogonal array of display pixels, such as electroluminescent devices, AC plasma panels, DC plasma panels and field emission displays and the like form a flat screen.

The basic structure of an AC Plasma Display Panel, or PDP, comprises two glass plates with a conductor pattern of electrodes on the inner surfaces of each plate. The plates are separated by a gas filled gap. The electrodes are configured in an x-y matrix with the electrodes on each plate deposited at right angles to each other using conventional thin or thick film techniques. At least one set of sustaining electrodes of the AC PDP is covered with a thin glass dielectric layer. The glass plates are assembled into a sandwich with the gap between the plates fixed by spacers. The edges of the plates are sealed and the cavity between the plates is evacuated and filled with a mixture of neon and xenon gases or a similar gas mixture of a type well known in the art.

During operation of an AC PDP, a sufficient driver voltage pulse is applied to the electrodes to ionize the gas contained between the plates. When the gas ionizes, the dielectrics charge like small capacitors, which reduces the voltage across the gas and extinguishes the discharge. The capacitive voltages are due to stored charge and are conventionally called wall charge. The voltage is then reversed, and the sum of the driver voltage and wall charge voltages is again large enough to excite the gas and produce a glow discharge pulse. A sequence of such driver voltages repetitively applied is called the sustaining voltage, or sustainer. With the sustainer waveform, pixels which have had charge stored will discharge and emit light pulses at every sustainer cycle. Pixels which have no charge stored will not emit light. As appropriate waveforms are applied across the x-y matrix of electrodes, small light emitting pixels form a visual picture.

Typically, layers of red, green or blue phosphor are alternately deposited upon the inner surface of one of the plates. The ionized gas causes the phosphor to emit a colored light from each pixel. Barrier ribs are typically disposed between the plates to prevent cross-color and cross-pixel interference between the electrodes. The barrier ribs also increase the resolution to provide a sharply defined picture. The barrier ribs further provide a uniform discharge space between the glass plates by utilizing the barrier rib height, width and pattern gap to achieve a desired pixel pitch.

Further details of the structure and operation of an AC PDP are disclosed in U.S. Pat. No. 5,723,945 titled "FLAT PANEL DISPLAY"; U.S. Pat. No. 5,962,983, entitled "METHOD OF OPERATION OF DISPLAY PANEL"; and U.S. patent application Ser. No. 09/259,940, filed Mar. 1, 1999, entitled "FLAT-PANEL DISPLAY", all of which are incorporated herein by reference.

SUMMARY OF THE INVENTION

This invention relates to an improved plasma flat-panel display which includes at least one auxiliary electrode disposed between each pair of sustaining electrodes.

It is known to manufacture plasma flat-panel displays having pairs of sustaining electrodes which establish a charged volume between the display substrates. The charge is controlled by applying voltages to a plurality of address electrodes. The charged volume is established by applying a voltage to the sustaining electrodes. The efficiency of the panel is generally greater when gas and geometry parameters are adjusted to increase the voltage required to sustain a discharge. However, this is in conflict with the need to have low voltages for economic and reliability purposes. Therefore, it would be desirable to develop a compromise device which would allow initiation and control of the sustaining discharge with a less powerful and lower voltage controlling means.

The present invention contemplates a plasma flat-panel display having a first transparent substrate with at least one pair of parallel sustaining electrodes deposited thereupon. A least one auxiliary electrode is deposited upon the first substrate parallel to the sustaining electrodes. The panel also includes an charge storage surface coating which covers the sustaining and auxiliary electrode.

The panel further includes a second substrate which is hermetically sealed to the first substrate, the second substrate having a plurality of gas-filled micro-voids formed in a surface thereof which is adjacent to the first substrate. The micro-voids are generally perpendicular to the sustaining and auxiliary electrodes and cooperate with the first substrate to define a plurality of sub-pixels. A plurality of address electrodes are incorporated within the second substrate, each of the address electrodes corresponding to one of the sub-pixels.

A first voltage is applied to the auxiliary electrode of sufficient magnitude to inject a charge of electrons between the auxiliary electrode and an associated sustaining electrode and initiate a discharge therebetween. A second voltage, that is greater than the first voltage is applied to the sustaining electrodes to extend the discharge to the other sustaining electrode. The voltage applied to the auxiliary electrode can be changed to urge the discharge deeper into the associated micro-void. In the preferred embodiment, the first voltage is applied before the second voltage; however, the invention also can be practiced with the first and second voltages being applied simultaneously or with the second voltage applied before the first voltage. The discharge between the sustaining electrodes can be controlled by applying a third voltage to the address electrodes.

It is further contemplated that a phosphor material is deposited within each micro-void and associated with the address electrodes. In the preferred embodiment, the first and second substrates are formed from glass. Additionally, the invention can be practiced having a pair of auxiliary electrodes disposed between the sustaining electrodes.

The plasma flat-panel also can include a plurality of pairs of sustaining electrodes, each pair of sustaining electrodes having at least one auxiliary electrode associated therewith. The micro-voids in the second substrate cooperate with the first substrate to define a plurality of sub-pixels which form rows parallel to the sustaining and auxiliary electrodes and columns which are perpendicular to the sustaining and auxiliary electrodes with each of the plurality of address electrodes incorporated within the second substrate corresponding to one column of the sub-pixels.

The invention further contemplates that the charge storage surface is covered by a thin film of electron emissive material. The electron emissive film may be optionally formed in a pattern from materials having differing electron emissive characteristics, for ease of generating secondary emission electrons. The ease of generating secondary emissive electrons for a material is referred to as the "gamma" of the material.

Various objects and advantages of this invention will become apparent to those skilled in the art from the following detailed description of the preferred embodiment, when read in light of the accompanying drawings.

DETAILED DESCRIPTION OF THE PREFERRED EMBODIMENTS

Figure 1:
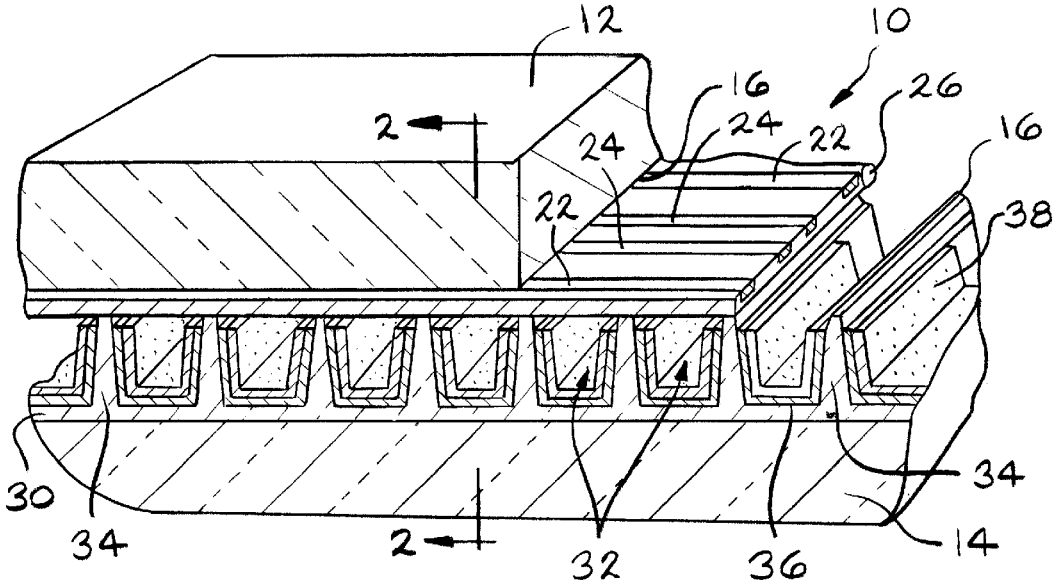
FIG. 1 is a perspective view of a plasma display panel in accordance with the invention.
Figure 2:
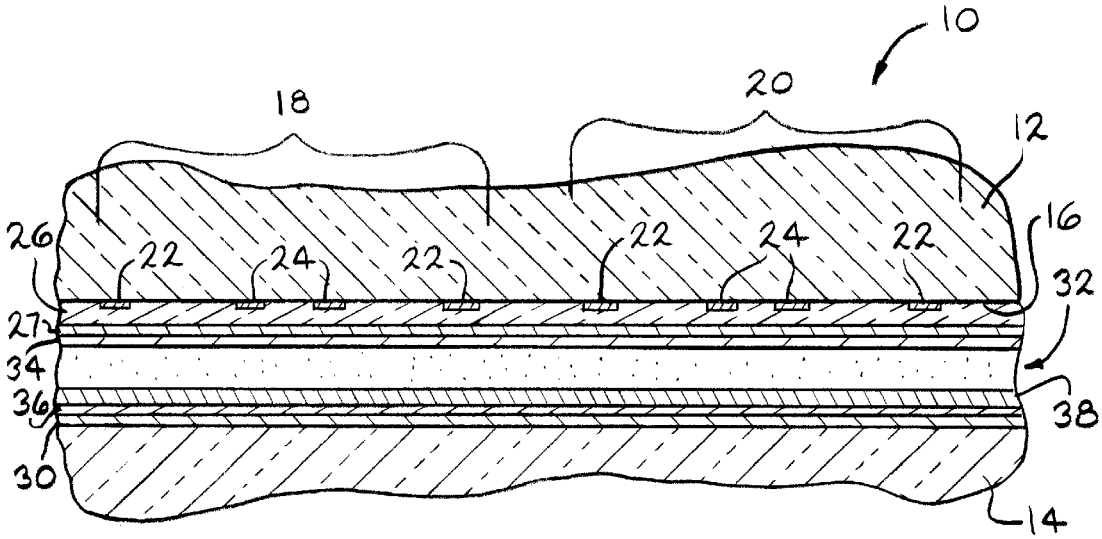
FIG. 2 is sectional view of the plasma display panel in FIG. 1 taken along line 2—2.

Referring now to the drawings, there is illustrated in FIGS. 1 and 2 the structure of an improved plasma display panel (PDP) 10, which, in the preferred embodiment, is an AC PDP. In the following description, like reference characters designate like or corresponding parts. Also, in the following description, it is to understood that such terms as "top", "bottom", "forward", "rearward", and similar terms of position and direction are used in reference to the drawings and for convenience in description.

Generally, the PDP 10 comprises a hermetically sealed gas filled enclosure including a top glass substrate 12 and a spaced apart bottom glass substrate 14. The top glass substrate 12 is superposed upon the bottom glass substrate 14. The glass substrates 12 and 14 are typically both transmissive to light and of a uniform thickness, although only the viewing side, normally the top substrate 12, is required to be transparent to visible light. For example, the glass substrates 12 and 14 may be approximately ⅛ to ¼ inch thick.

The top glass substrate 12 may contain $SiO_2$, $Al_2O_3$, $MgO_2$ and CaO as the main ingredients and $Na_2O$, $K_2O$, PbO, $B_2O_3$ and the like as accessory ingredients. Deposited upon a lower surface 16 of the top substrate 12 are a plurality of sets of parallel electrodes. One such set, which is labeled 18, is illustrated in FIGS. 1 and 2 while a second set, which is labeled 20, is illustrated only in FIG. 2. Each set of electrodes includes an outer pair of display, or sustainer, electrodes 22, which typically have a spacing of approximately 800 microns. Disposed between each pair of sustainer electrodes 22 are a pair of auxiliary electrodes 24, which typically have a spacing within the range of 100 microns to 400 microns. As shown in FIG. 2, the pair of auxiliary electrodes 24 are centered between the pair of sustainer electrodes 22. The electrode pairs 22 and 24 are formed by a conventional process. In the preferred embodiment, the electrode pairs 22 and 24 are thin film electrodes prepared from evaporated metals such as Au, Cr and Au, Cu and Au, Cu and Cr, ITO and Au, Ag, or Cr and the like.

A uniform charge storage film 26 such as a dielectric film of a type well known in the art covers the electrode pairs 22 and 24 by a variety of planar techniques well known in the art of display manufacture. The charge storage film 26 may be of most any suitable material, such as a lead glass material. In the preferred embodiment, the charge storage film 26 is covered by a thin electron emissive layer 27 The electron emissive layer 27 may be formed from most any suitable material, such as diamond overcoating, MgO, or the like. As will be explained below, the electron emissive layer 27 may be uniform or patterned.

As shown in FIG. 1, the bottom substrate 14 supports an intermediate glass layer 30 which is disposed between the top and bottom substrates 12 and 14. The intermediate layer 30 has a plurality of parallel microgrooves 32 formed therein which are generally perpendicular to the sustaining and auxiliary electrode pairs 22 and 24. The microgrooves 32 are separated by barrier ribs 34 which extend in an upward direction in FIG. 1. The upper end of each of the barrier ribs 34 contacts the electron emissive layer 27 which is deposited upon the lower surface 16 of the top substrate 12. Alternately, the microgrooves 32 and barrier ribs 34 can be etched directly into the upper surface of the bottom substrate 14 (not shown). Whichever process is utilized, the microgrooves 32 and barrier ribs 34 are preferably formed from an etchable glass material which is inherently selectively crystallizing, such as, a glass-ceramic composite doped with suitable nucleating agents.

Address electrodes 36 are deposited along the base and surrounding sidewalls of each microgroove 32. The address electrodes 36 are deposited along the base and surrounding sidewalls to increase uniformity of firing and provide optimum phosphor coating along the entire surface of the microgroove 32. The address electrodes 36 are deposited by selectively metalizing a thin layer of Cr and Au or Cu and Au, or Indium Tin Oxide (ITO) and Au, or Cu and Cr, or Ag or Cr within the micrgroove surfaces. The metalization may be accomplished by thin film deposition, E-beam deposition or electroless deposition and the like as well known in the art. Because the microgrooves 32 are generally perpendicular to the electrode pairs 22 and 24, the address electrodes 36 co-operate with the sustaining and auxiliary electrode pairs 22 and 24 to define an orthogonal electrode matrix.

Instead of microgrooves, it will be appreciated that the invention also can be practiced utilizing micro-voids (not shown) formed by creating wells on the surface of the bottom substrate over and aligned with the sustaining and auxiliary electrode pairs 22 and 24. The non-voided surface areas form barrier ribs perpendicular to the sustaining and auxiliary electrode pairs 22 and 24 and divider ribs parallel to and separating the sustaining and auxiliary electrode pairs 22 and 24. Alternately, parallel barrier ribs can be formed on the surface of the bottom substrate over and aligned with address electrodes to form the micro-voids, as disclosed in U.S. patent application Ser. No. 09/259,940, which is referenced above.

A phosphor material 38 is deposited over at least a portion of each address electrode 36. In a preferred embodiment, the phosphor material 38 is deposited by electrophoresis as well known in the art. The phosphor material is of a type well known in the art and for a full color display red, green and blue phosphors are separately deposited in an alternating pattern to define individual pixels. The resolution of the PDP 10 is determined by the number of pixels per unit area.

Additional details of the structure of the PDP 10 are given in the above referenced U.S. Pat. No. 5,723,945.

The channels 32 are filled with a proportioned mixture of two or more ionizable gases which produces sufficient UV radiation to excite the phosphor material 38. In the preferred embodiment, a gas mixture of neon and from about five to 20 percent by weight of xenon and helium is used.

The sustaining, control and address electrodes are externally connected to conventional plasma display panel driving circuitry (not shown).

The operation of the PDP 10 will now be described. Generally, a discharge is initiated between a selected pair of auxiliary electrodes 24 by applying a first voltage across the auxiliary electrodes. Because the auxiliary electrodes are relatively close together, the first voltage needed to initiate the discharge is less than the voltage required to initiate a discharge between the sustaining electrodes.

The establishment of a discharge between a pair of auxiliary electrodes 24 functions as a primer for establishing a discharge between the associated pair of sustaining electrodes 22. Once a discharge is initiated between a pair of sustaining electrodes 22, the discharge can be sustained by applying a second voltage to the sustaining electrode pair 22. The magnitude of the second voltage is greater than the magnitude of the first voltage. Additionally, in the preferred embodiment, the second voltage is an alternating voltage. The resulting discharge is further controlled by applying voltages to selected address electrodes 36, as described in U.S. Pat. No. 5,962,983, which is referenced above. The voltage applied the sustaining electrodes 22 is typically referred to as a sustaining voltage.

Figure 3A:
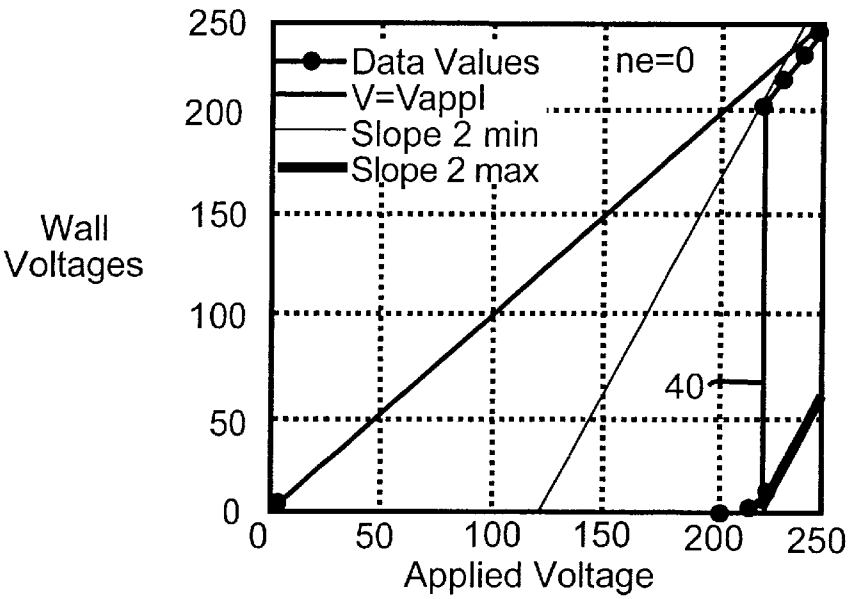
FIG. 3 illustrates the operation of the plasma display panel shown in FIG. 1.
Figure 3B:
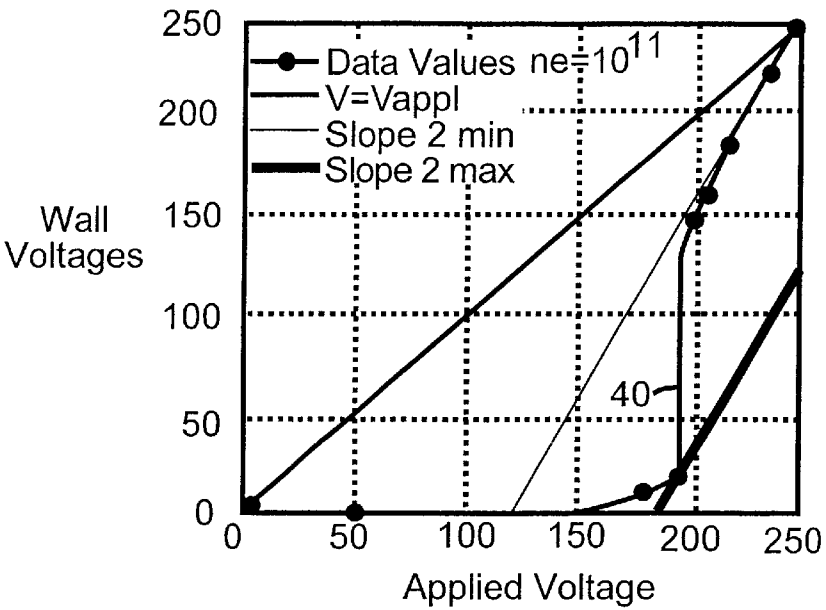
Figure 3D:
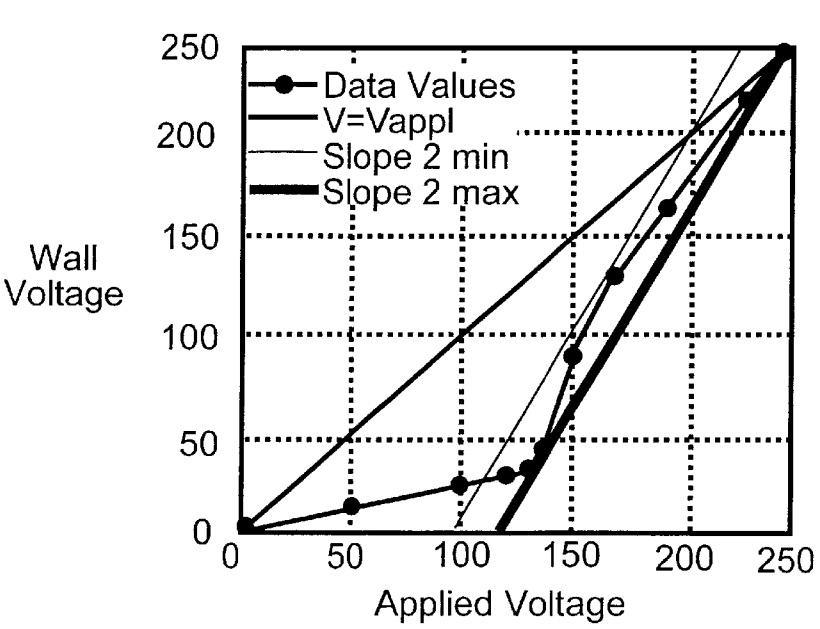
Figure 3C:
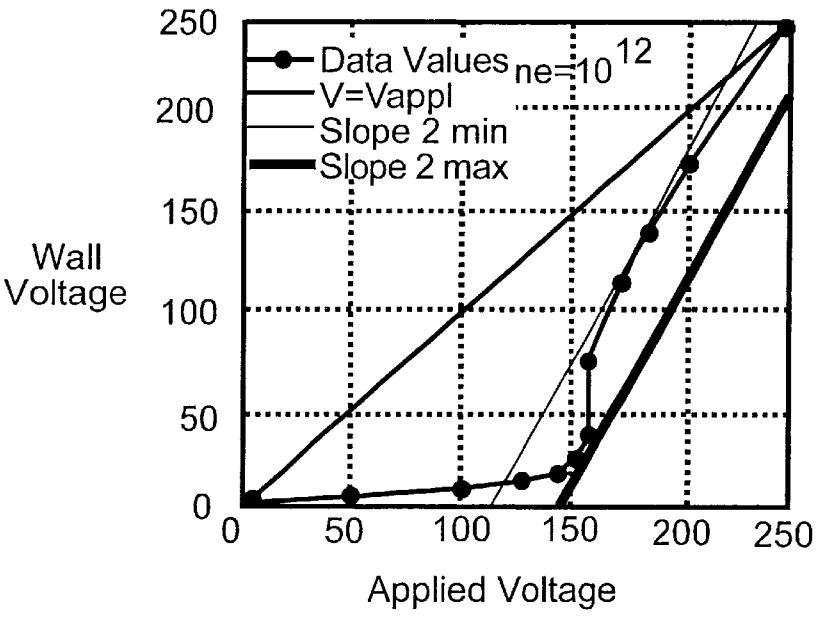

The auxiliary electrodes 24 inject a "starting" charge of ne (number of electrons) into the volume between the associated sustaining electrodes 22. The starting charge ne is a function of the voltage applied to and the spacing between the auxiliary electrodes 24. The effect of the auxiliary electrodes is illustrated by the graphs shown in FIGS. 3A through 3D. In the graphs, the horizontal axis is the voltage applied across the sustaining electrodes 22, while the vertical axis is the resulting voltage appearing across the walls of the microgrooves 32, which is directly proportional to the charge deposited thereon. In FIG. 3A, the starting charge is zero, which corresponds to zero voltage applied to the auxiliary electrodes 24, or a PDP which does not have auxiliary electrodes. The curve labeled 40 represents the transfer characteristic of the PDP 10. As a voltage applied to the auxiliary electrodes, as illustrated in FIG. 3B, and progressively increased, as illustrated in FIGS. 3C and 3D where the starting charge increases from $10^{11}$ to $10^{13}$, the sustaining voltage required for a given wall voltage decreases. For example, for a wall voltage of 100 volts, the sustaining voltage decreases from about 220 volts in FIG. 3A to about 150 volts in FIG. 3D due to the use of the auxiliary electrodes 24.

Figure 4:
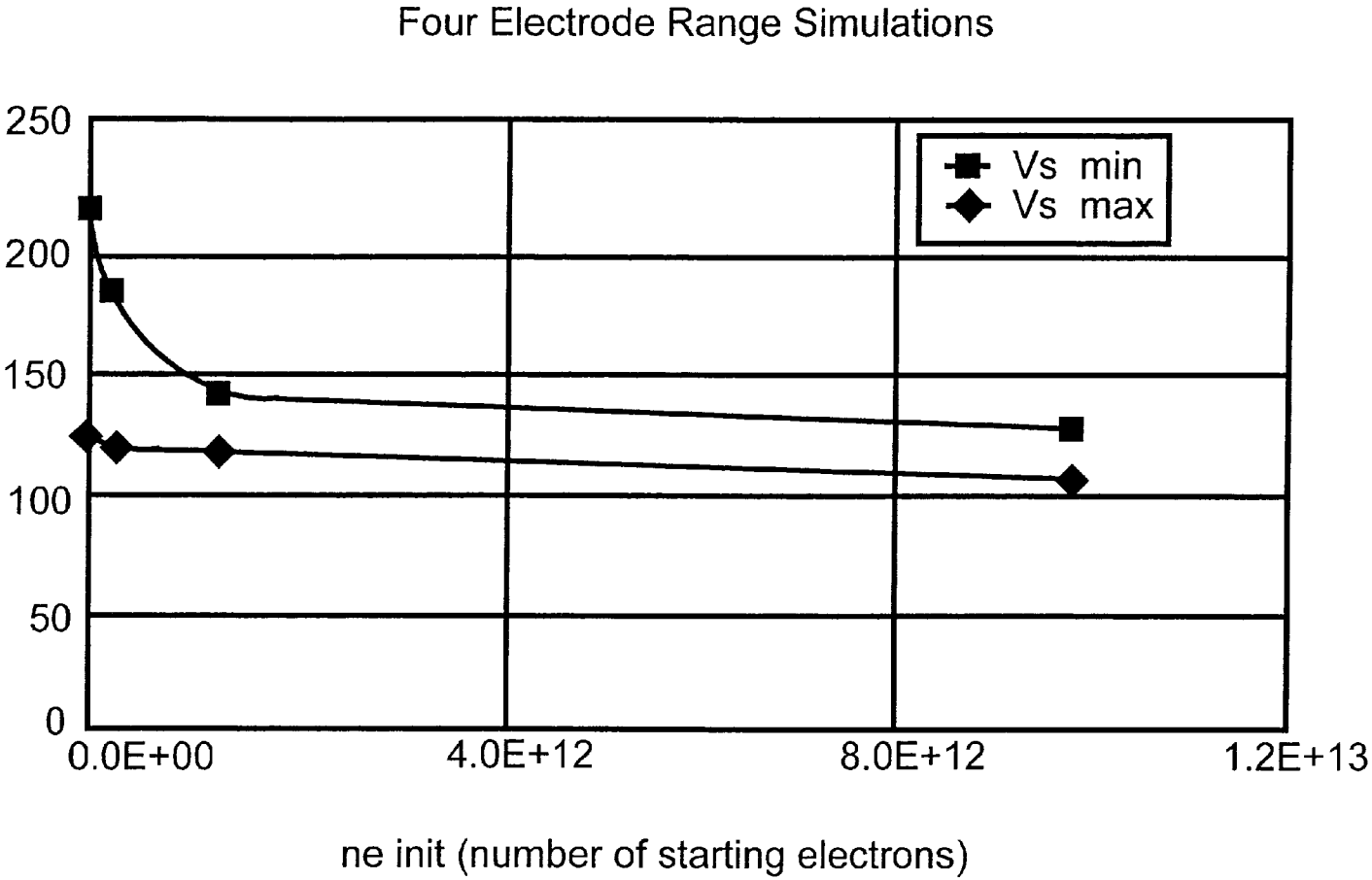
FIG. 4 also illustrates the operation of the plasma display panel shown in FIG. 1.

The geometry of a discharge cell which has a high efficiency, often due to a relatively long discharge path, tends to also have a very high firing voltage. Because the auxiliary electrodes 24 enable operation of the PDP 10 at lower sustaining voltages, as illustrated in FIG. 4, a compromise between high efficiency and practical operating voltage is achieved, and the overall power required to operate the PDP 10 is reduced. In FIG. 4, the horizontal axis represents the magnitude of the starting charge ne established by the auxiliary electrodes while the vertical axis represents the corresponding voltage needed to sustain a discharge between the sustaining electrodes 22. The vertical axis also represents zero ne, or a PDP without auxiliary electrodes. Minimum and maximum bounds are shown in FIG. 4 and, clearly, the magnitude of the sustaining voltage is reduced as the starting charge is reduced by the auxiliary electrodes 24. Also, the discharge extends away from the surface emission layer 27 and into the adjacent microgroove 32. As will be explained below, this excites more of the phosphor material 38 to further enhance the efficiency of the plasma display panel.

Figure 5:
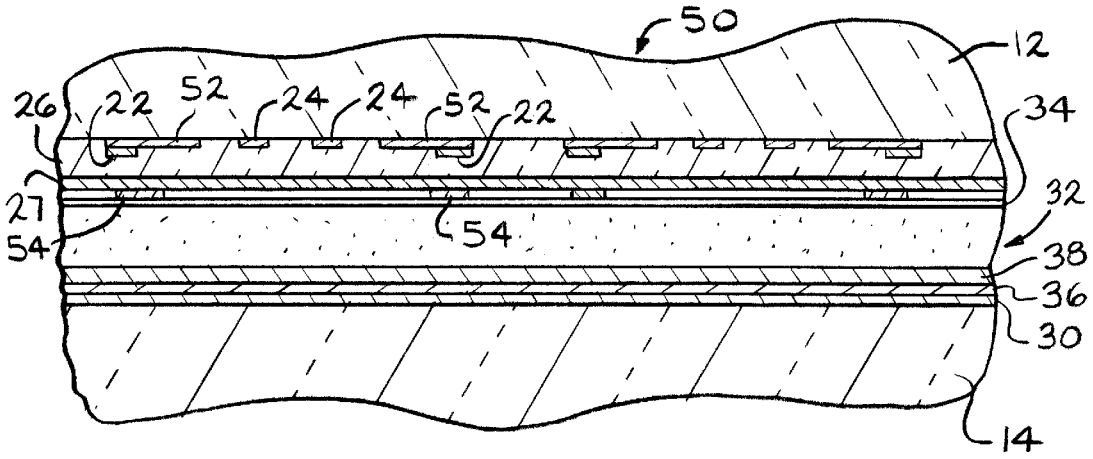
FIG. 5 is a sectional view of an alternate embodiment of the plasma display panel shown in FIG. 1.

While the preferred embodiment of the invention has been illustrated and described above, it will be appreciated that the invention also can be practiced with alternative PDP's. For example, an alternate embodiment of the PDP which incorporates the invention is illustrated generally at 50 in FIG. 5, where components which are similar to components shown in FIGS. 1 and 2 have the same numerical designators. In FIG. 5, each of the sustaining electrodes 22 includes an associated extension electrode 52. Also, a plurality conductive charge storage pads 54 are disposed upon the lower surface of the electron emissive layer 27. The extension electrodes 52 and conductive storage pads 54 increase the efficiency of the PDP 50 are described in the above referenced U.S. patent application Ser. No. 09/259,940.

Figure 6:
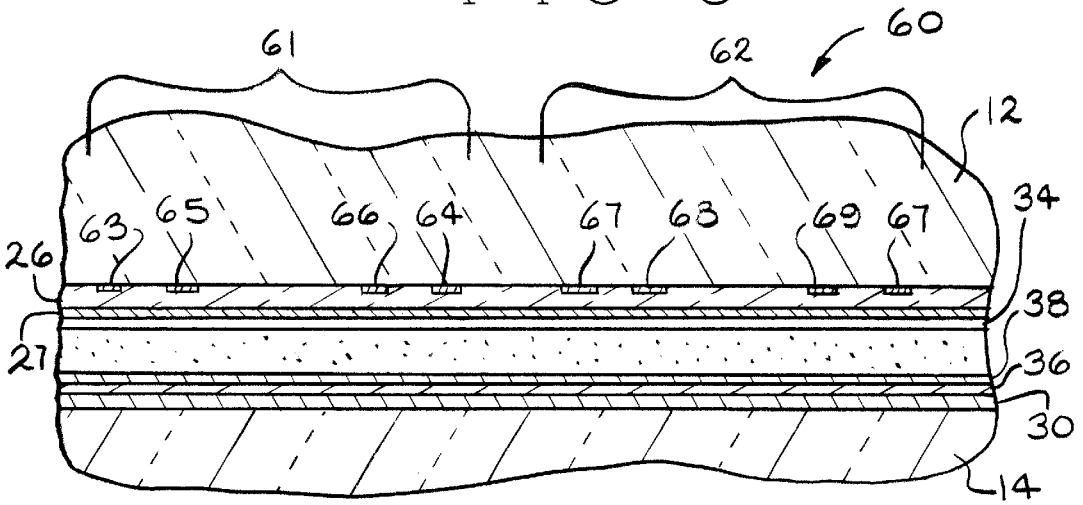
FIG. 6 is a sectional view of another alternate embodiment of the plasma display panel shown in FIG. 1.

Another alternate embodiment of the invention is shown generally at 60 in FIG. 6. As above, components of the PDP 60 which are similar to components shown in FIGS. 1 and 2 have the same numerical designators. As before, two sets of parallel electrodes, 61 and 62, are shown deposited upon the lower surface of the top substrate 12. The first set of electrodes 61 includes a pair of sustaining electrodes 63 and 64. A first auxiliary electrode 65 is disposed adjacent to the left sustaining electrode 63. In the preferred embodiment, the first auxiliary electrode 65 is separated from the left sustaining electrode 63 by about 40 microns to 100 microns. Similarly, a second auxiliary electrode 66 is disposed adjacent to the right sustaining electrode 64. In the preferred embodiment, the second auxiliary electrode 66 is separated from the right sustaining electrode 64 by about 40 microns to 100 microns. Similarly, the second set of electrodes 62 includes a pair of sustaining electrodes 67 having first and second auxiliary electrodes 68 and 69 disposed adjacent thereto.

The operation of the PDP 60 will now be described with reference to the to first set of electrodes 61 in FIG. 6. Initially, a first voltage is applied to the first auxiliary electrode 65 which establishes a starting charge of electrons between the first auxiliary electrode 65 and the left sustaining electrode 63. The charge of electrons may be the result of a relatively small discharge between the auxiliary electrode 65 and a sustaining electrode 63. The starting charge enables establishment of a relatively larger discharge between the sustaining electrodes 63 and 64 with a lower sustaining voltage than would be needed in the absence of the starting charge. Additionally, it is normally desired that the sustaining electrode 63 be a cathode with respect to the auxiliary electrode 65 at this phase of the operation.

As indicated above, the PDP 60 is an AC device. Accordingly, as the applied alternating sustaining voltage passes through zero at the end of the first half cycle of the AC voltage cycle, an initial voltage is applied to the second auxiliary electrode 66 and the voltage applied to the first auxiliary electrode 65 is returned to its initial voltage. The auxiliary electrode voltage establishes a starting charge of electrons between the second auxiliary electrode 66 and the right sustaining electrode 64. As the sustaining voltage increases in the opposite direction during the second half of the AC voltage cycle, a discharge is reestablished between the sustaining electrodes 63 and 64. Again, the starting charge enables establishment of a discharge between the sustaining electrodes 63 and 64 with a lower sustaining voltage than would be needed in the absence of the starting charge. During this phase of the operation, care is taken so that no discharge or starting electrons are produced at the site of the auxiliary electrode 65, as it is desired that the sustaining electrode 63 functions as an anode. This can be accomplished by appropriate waveform timing, or, as will be explained below, by utilizing materials having different gammas to form the electron emissive layer 27. The second set of auxiliary electrodes 68 and 69 cooperate with the second set of sustaining electrodes 67 in the same manner to establish a discharge between the sustaining electrodes 67.

Figure 7:
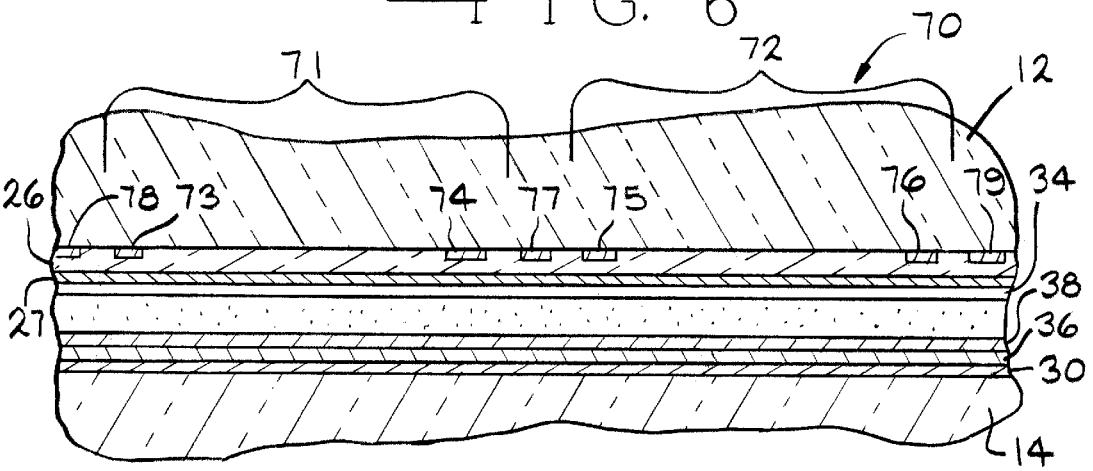
FIG. 7 is a sectional view of another alternate embodiment of the plasma display panel shown in FIG. 1.

Another alternate embodiment of the invention is shown generally at 70 in FIG. 7. As above, components of the PDP 70 which are similar to components shown in FIGS. 1 and 2 have the same numerical designators. Two pairs of sustaining electrodes. 71 and 72, are shown deposited upon the lower surface of the top substrate 12. The first pair of sustaining electrodes 71 includes a left sustaining electrode 73 and right sustaining electrode 74. Similarly, the second set of sustaining electrodes 72 includes a left sustaining electrode 75 and a right sustaining electrode 76. In the embodiment 70 shown in FIG. 7, the auxiliary electrodes are disposed between the pair of sustaining electrodes. Thus a single auxiliary electrode 77 is disposed between the first pair of sustaining electrodes 71 and the second pair of sustaining electrodes 72. A second auxiliary electrode 78 is shown at the left of FIG. 7 and is disposed between the first pair of sustaining electrodes 71 and the next pair of sustaining electrodes to the left in FIG. 7 (not shown). Similarly, a third auxiliary electrode 79 is shown at the right of FIG. 7 and is disposed between the second pair of sustaining electrodes 72 and the next pair of sustaining electrodes to the right in FIG. 7 (not shown).

The operation of the PDP 70 will now be explained. Adjacent pairs of sustaining electrodes are excited with AC voltages having opposite polarities. Accordingly, an initial voltage is applied to the common auxiliary electrode 77. The initial auxiliary voltage establishes two sets of starting charges. A first staring charge extends from the auxiliary electrode 77 to the left in FIG. 7 to the right sustaining electrode 74 in the first sustaining electrode pair 71, and a second starting charge extends from the auxiliary electrode 77 to the right in FIG. 7 to the left sustaining electrode 75 in the second sustaining electrode pair 72. As the AC voltage applied between the pairs of sustaining electrodes 71 and 72 is increased, a discharge is established therebetween. As described above, the starting charge established by the auxiliary electrode 77 enables establishment of the discharge between the sustaining electrode pairs 71 and 72 at a lower value than in the absence of the auxiliary electrode. As the alternating sustaining voltage passes through zero at the end of the first half of the AC voltage cycle, an initial voltage is applied to the second and third auxiliary electrodes 78 and 79 while the voltage applied to the first auxiliary electrode 77 is reduced to zero. The second and third auxiliary electrodes 78 and 79 cooperate with the adjacent sustaining electrodes 73 and 76, respectively, to establish starting charges therebetween. As the sustaining voltage continues to increase in the opposite direction, discharges are reestablished between the sustaining electrode pairs 71 and 72. The auxiliary electrodes 78 and 79 are also cooperating with sustaining electrodes (not shown) to the left of the second auxiliary electrode 78 and to the right of the third auxiliary electrode 79 to establish starting charges therebetween.

Figure 8:
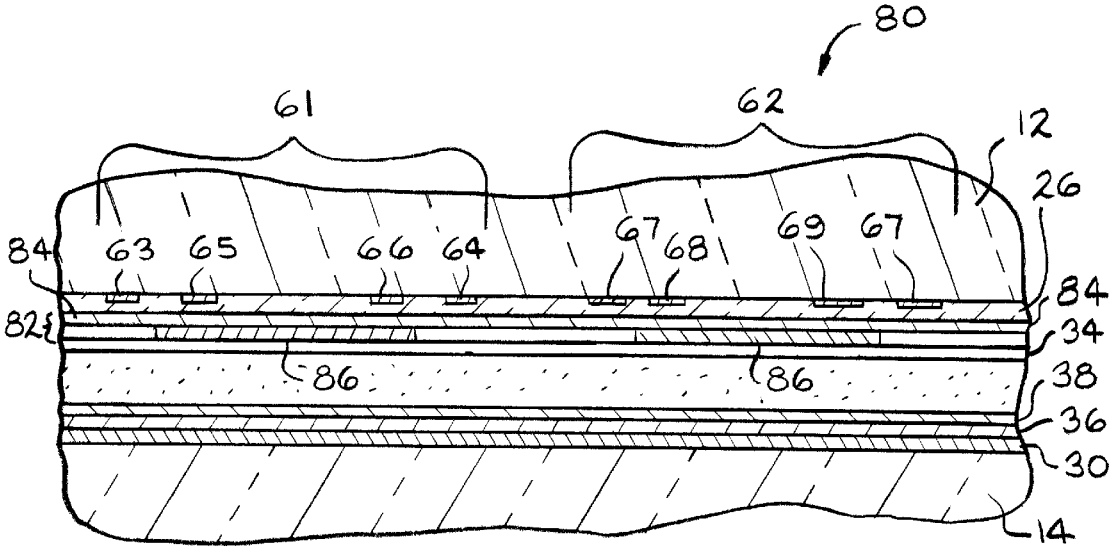
FIG. 8 is a sectional view of an alternate embodiment of the plasma display panel shown in FIG. 6.

It has been found that there is a further advantage when the gamma of the electron emissive layer is greater over the sustaining electrode 63 relative to the gamma of the electron emissive layer over the auxiliary electrode 65. This assures that the sustaining electrode 63 functions as a cathode with respect to the sustaining electrode 65. Accordingly, the present invention contemplates an alternate embodiment of the PDP 60 which is shown generally at 80 in FIG. 8. Components of the PDP 80 which are similar to components shown for the PDP 60 have the same numerical designators. The PDP 80 includes an electron emissive layer 82 formed from two materials having different gammas. A first layer electron emissive material 84 having a first gamma is deposited over the entire surface of the charge storage film 26. A second layer of electron emissive material 86 having a second gamma is deposited over portions of the first layer 84 adjacent to the auxiliary electrodes 65, 66, 68 and 69. The second layer 86 can be formed by completely covering the first layer 84 and then etching away the portions of the second layer 86 which are adjacent to the sustaining electrodes 63, 64 and 67. In the preferred embodiment the first layer 84 is formed form a material having a gamma greater than the gamma of the second layer 86. Typically, the first layer 84 can be formed from PbO and the second layer 86 can be formed from MgO. Accordingly, the first layer 84 will fire at a lower voltage and function as the cathode described above.

Figure 9:
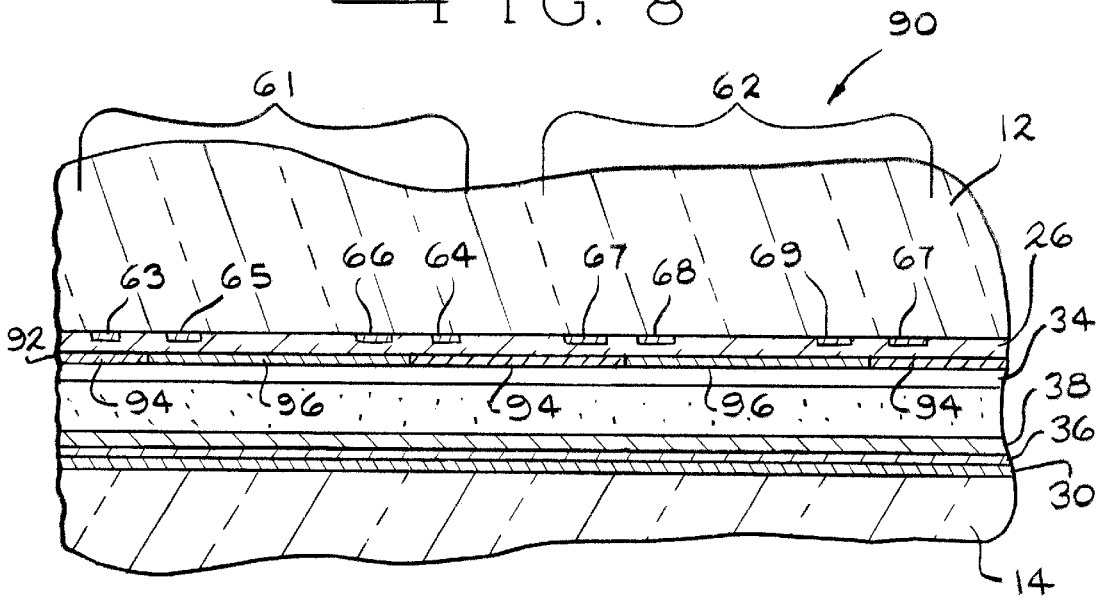
FIG. 9 is a sectional view of an alternate embodiment of the plasma display panel shown in FIG. 8.

An alternate embodiment of the PDP 80 is generally shown at 90 in FIG. 9, where similar components have the same numerical designators. The PDP 90 has an electron emissive layer 92 formed from a first electron emissive material 94 having a first gamma alternating with a second electron emissive material 96 having a second gamma.

While the preferred embodiments of the PDP's 60, 70, 80 and 90 have been illustrated and described above, it will be appreciated that the extension electrodes 52 and conductive storage pads 54 shown in FIG. 5 can be included in the PDP's 60, 70, 80 and 90. Additionally, the patterned electron emissive layers 82 and 92, respectively, illustrated in FIGS. 8 and 9 also may be applied to the examples of PDP's shown in FIGS. 2 and 5 through 7.

The present invention also contemplates alternate methods of operation of the plasma display panel which increase the efficiency of the panel. The inventors have determined that a long discharge path buried deep within the channel 32 for a long time period is desirable. Modifying the electrode parameters can create such a discharge structure. For example, the inventors have found that with two narrow "bus" electrodes separated by a wide gap and having no ITO, the discharge initiates not across the gap between the electrodes, but from the address electrode to one of the bus electrodes (not shown). The inventors have studied the relationship between the electrode gap length and the efficiency of panel. The inventors found that the bigger the electrode gap length, the higher efficiency. However, this approach to increasing panel efficiency is usually impractical because of the higher driving voltage at the large electrode gap length.

Figure 10:
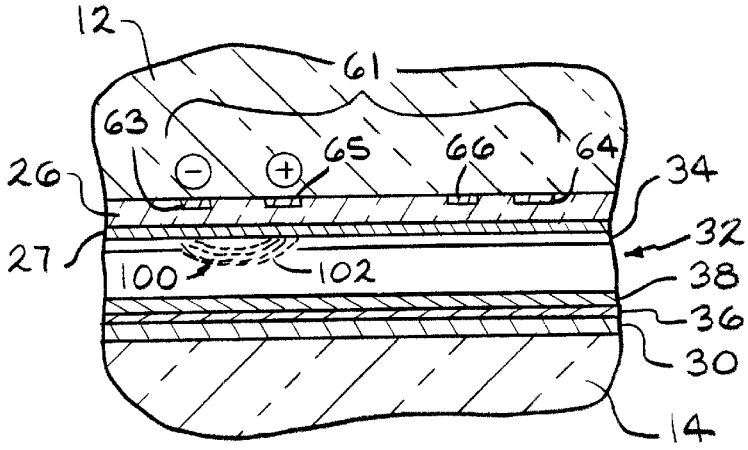
FIG. 10 illustrates a first step ;of an alternate method for operating the plasma display panel shown in FIG. 6 which is in accordance with the invention.
Figure 11:
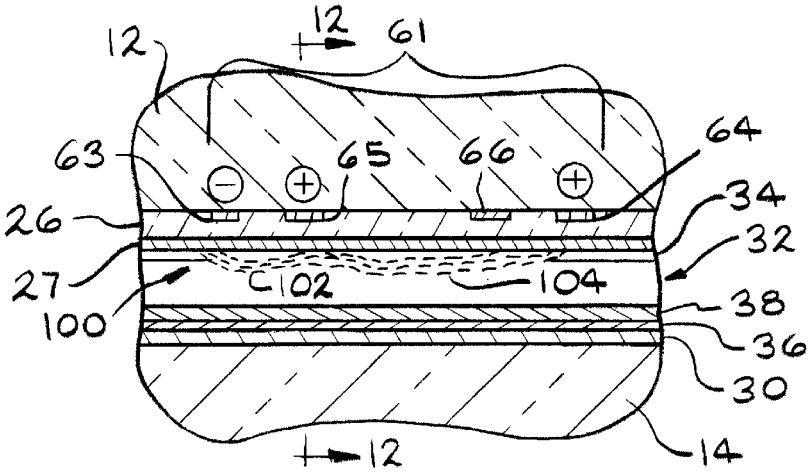
FIG. 11 illustrates a second step in the method of operation shown in FIG. 10.

Accordingly, the inventors have found that alternate methods of operation can be applied the auxiliary electrodes described above can be used to help initiate, control, or guide the discharge. Entirely new discharge structures can be created in this manner. Such a case is illustrated in FIGS. 10 through 15 with the structure of the PDP 60 shown in FIG. 6. It will be appreciated that, while the PDP 60 is used in the illustration, the method also can be applied to other PDP structures. In FIGS. 10 through 15, a discharge 100 comprising two parts is made to occur. The initial step is shown in FIG. 10 and is similar to the first step described above for the operation of the PDP 60 with a first voltage applied between the left sustaining electrode 63 and the first auxiliary electrode 65. As shown in FIG. 10, the sustaining electrode 63 is at a negative potential with respect to the first auxiliary electrode 65. Hence the left sustaining electrode 63 is functioning as a cathode in FIG. 10. The first voltage causes an initial discharge between the electrodes 63 and 65 which is referred to as the cathode fall region 102 of the discharge 100. Once the initial discharge is established, a second voltage, which is greater than the first voltage, is applied between the sustaining electrodes 63 and 64, with the right sustaining electrode 64 functioning as an anode, as shown in FIG. 11. As described above, the second voltage is often referred to as the sustaining voltage. The sustaining voltage draws the discharge 100 through the channel 32. The discharge 100 arcs through the channel 32 away from the electron emissive layer 27.

Figure 12:
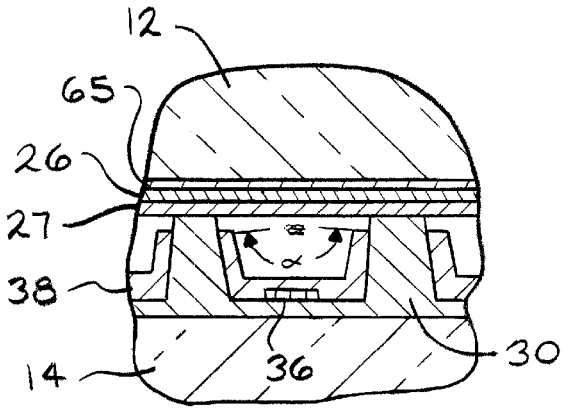
FIG. 12 is a transverse view of the plasma display panel shown taken along line 12—12 in FIG. 11.
Figure 13:
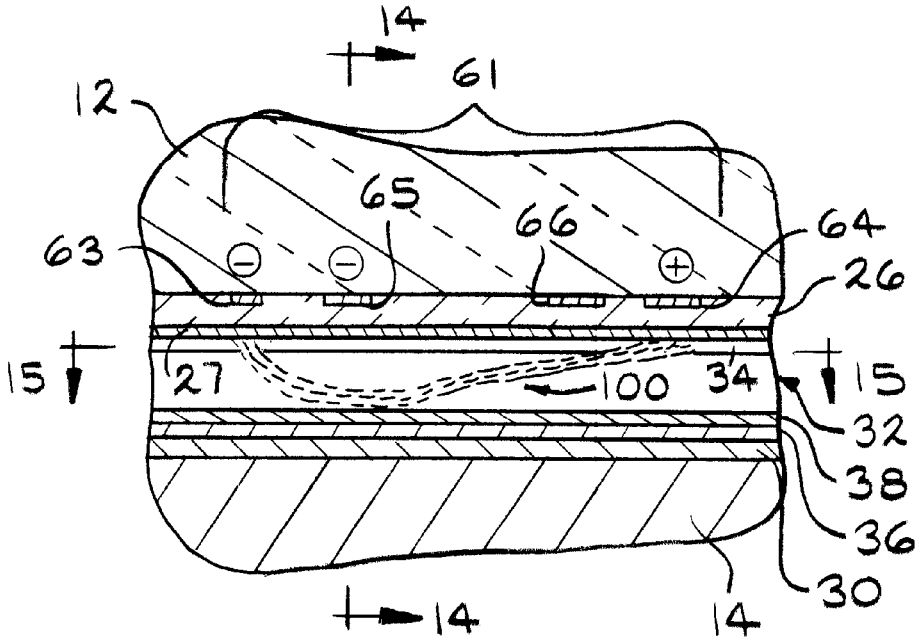
FIG. 13 illustrates a third step in the method of operation shown in FIG. 10.
Figure 14:
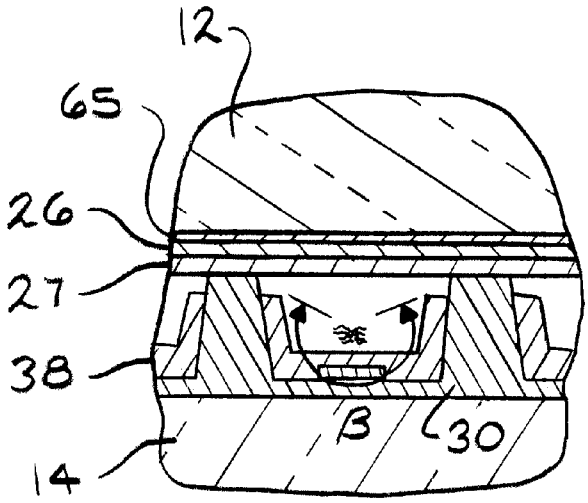
FIG. 14 is a transverse view of the plasma display panel shown taken along line 14—14 in FIG. 13.

As shown in FIG. 12, while the discharge 100 is not a surface discharge, the discharge 100 is in proximity to the electron emissive layer 27. Thus, the entire UV producing action is in the upper portion of the channel 32 with nearly half of the UV produced being absorbed by the electron emissive layer 27. However, the inventors have determined that varying the voltage applied to the is first auxiliary electrode 65 can control the depth to which the discharge 100 extends into the channel 32. For example, applying a negative voltage to the first auxiliary electrode 65 urges the discharge 100 deeper into the channel 32, as illustrated in FIGS. 13 and 14.

Figure 15:
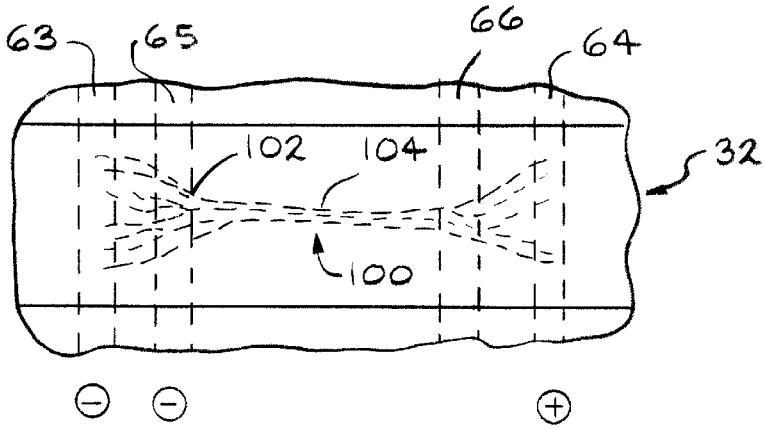
FIG. 15 is a plan view of the plasma display panel taken along line 15—15 in FIG. 13.

The discharge also forms a positive column like portion 104, as shown in the plan view in FIG. 15. The positive column like portion 104 is similar to the discharge occurring in an illuminated fluorescent light tube. With the discharge 100 urged deeper into the channel 32, much more of the UV is incident on the phosphor material 38 and illumination efficiency is increased. This is shown as the incident angle, $\beta$, of the UV upon the phosphor material 38, as shown in FIG. 14, is significantly greater than the incident angle, $\alpha$, as shown in FIG. 12.

Once the discharge 100 is initiated in the channel 32, the sustaining voltage applied between the left and right sustaining electrodes 63 and 64 alternates to maintain the illumination of the corresponding PDP pixel.

Figure 16:
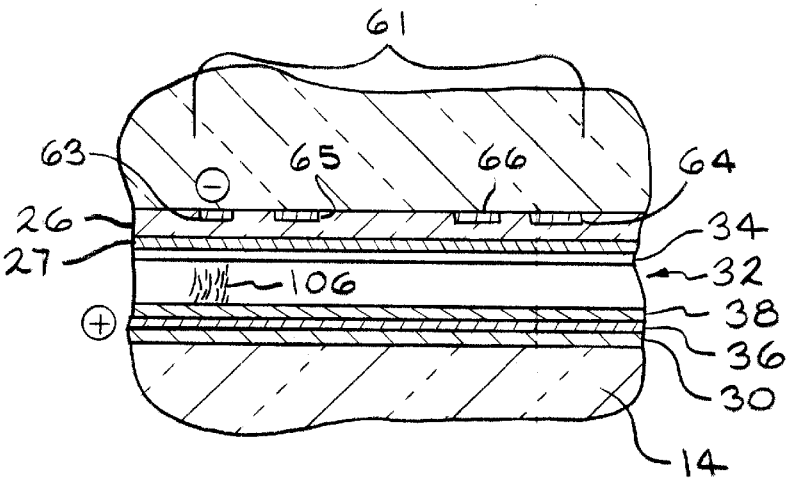
FIG. 16 is a first step of an alternate embodiment of the method of operation of the plasma display panel shown in FIGS. 10 through 15.
Figure 17:
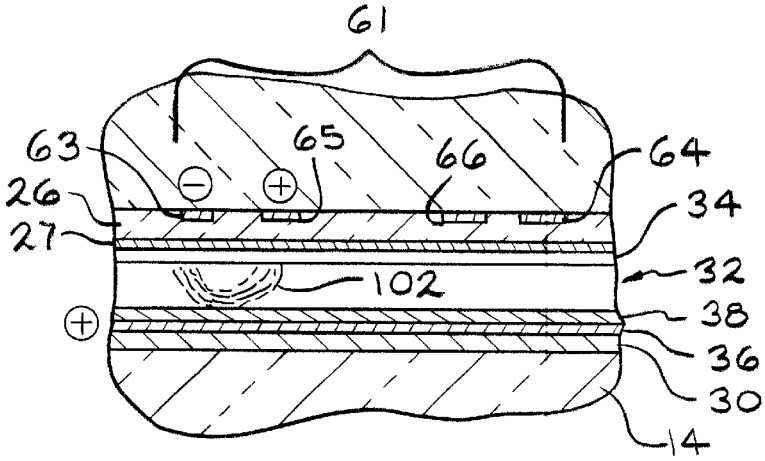
FIG. 17 is a second step in the method shown in FIG. 16.
Figure 18:
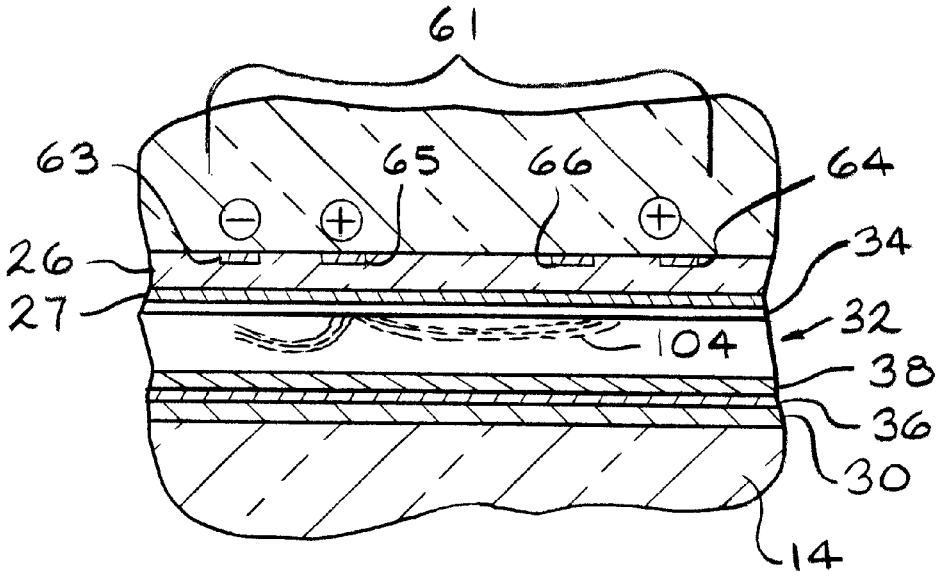
FIG. 18 is a third step in the method shown in FIG. 16.
Figure 19:
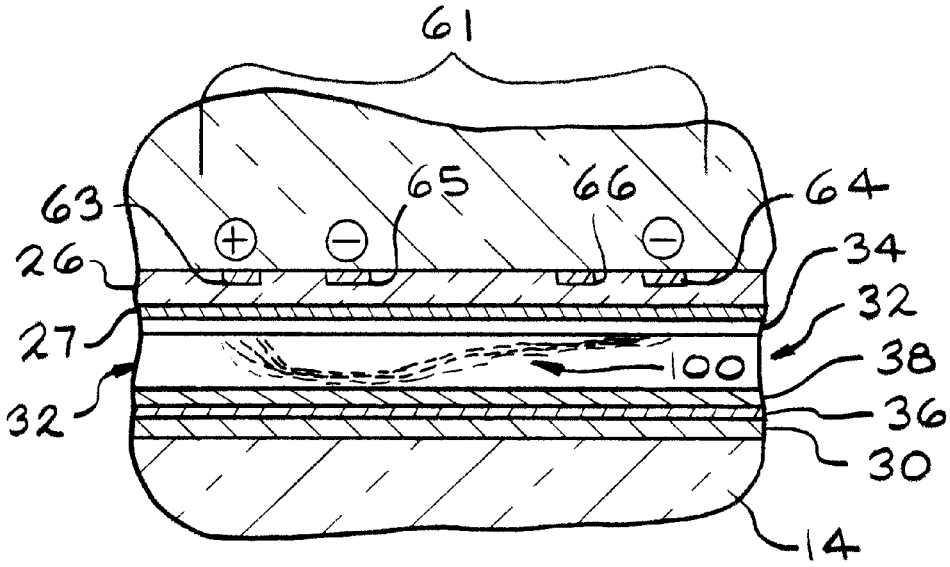
FIG. 19 is a fourth step in the method shown in FIG. 16.

An alternate three-step method for initiating a discharge is illustrated in FIGS. 16 thorough 19. In FIG. 16, a first voltage is applied between the left sustaining electrode 63 and the opposite address electrode 36. As above, the left sustaining electrode 63 is negative relative to the address electrode 36 and functions as a cathode. An initial discharge 106 is established in FIG. 16 between the left sustaining electrode 63 and the address electrode 36. The initial discharge 106 is moved to the right in FIG. 17 by application of a second voltage between the left sustaining electrode 63 and the first auxiliary electrode 65 to establish the cathode fall region 102 described above. The operation then proceeds as described above with a third sustaining voltage applied between the sustaining electrodes 63 and 64 in FIG. 18. As above, the voltage applied to the first auxiliary electrode 65 can be varied to control the depth to which the discharge 100 extends into the channel 32. For example, polarity of the voltage on the first auxiliary electrode 65 is reversed in FIG. 19 to urge the discharge 100 deeper into the channel 32. Once the discharge 100 is established between the sustaining electrodes 63 and 64, the sustaining voltage alternates to maintain the illumination of the associated PDP pixel.

Figure 20:
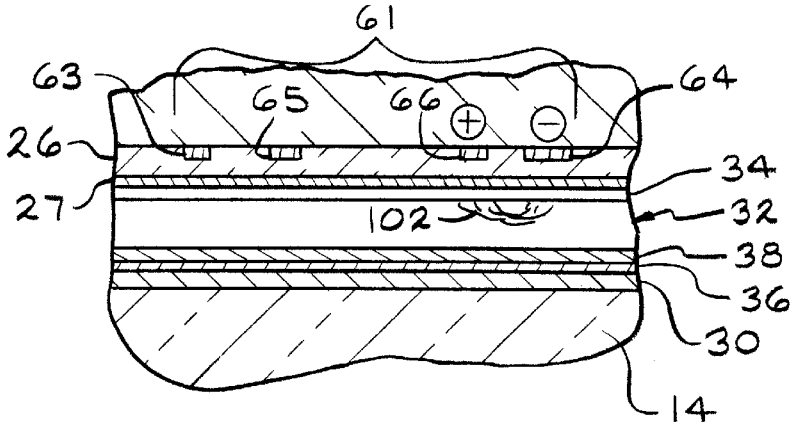
FIG. 20 is a first step of an alternate embodiment of the method of operation of the plasma display panel shown in FIGS. 10 through 15.
Figure 21:
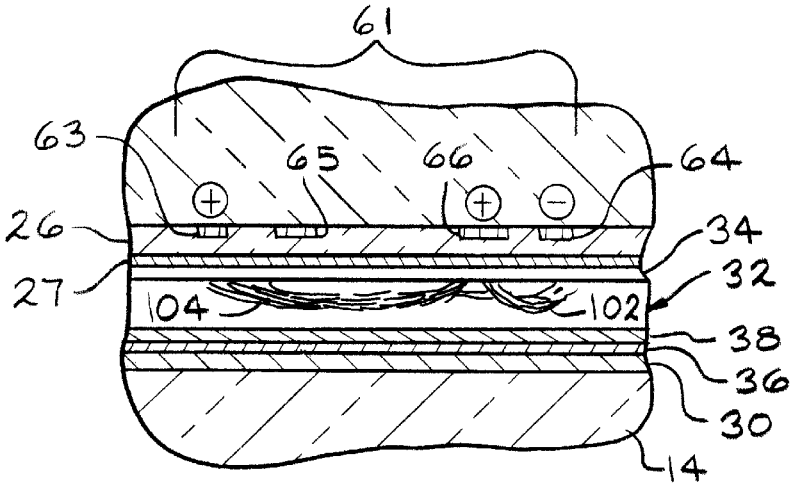
FIG. 21 is second step in the method shown in FIG. 20.
Figure 22:
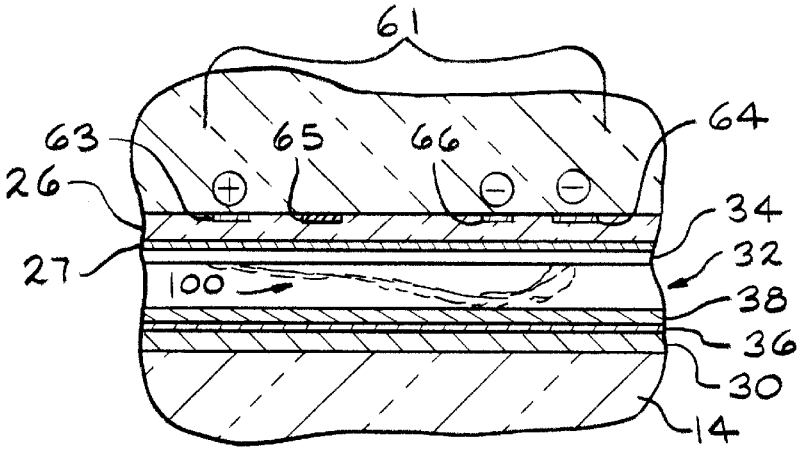
FIG. 22 is a third step in the method shown in FIG. 20.

While the preferred embodiment has been illustrated and described as having the left sustaining electrode 63 initially having a negative voltage and functioning as a cathode, it will be appreciated that the invention also can be practiced with the voltages reversed and with the left sustaining electrode 63 functioning as an anode. Such a situation is illustrated in FIGS. 20 through 22. In FIG. 20, a negative voltage is applied.to the right sustaining electrode 64 and a positive voltage is applied to the second auxiliary electrode 66 to initiate the cathode fall region 102. Then, in FIG. 21, a sustaining voltage, which is greater than the voltage between the right sustaining electrode 64 and the second auxiliary electrode 66, is applied between the sustaining electrodes 64 and 63 with the left sustaining electrode 63 being positive relative to the right sustaining electrode 64. As before, the sustaining voltage draws the discharge through the channel 32, with the discharge moving from right to left in FIG. 21. Finally, the voltage on the second auxiliary electrode 66 is reversed, as shown in FIG. 22, to urge the discharge 100 deeper into the channel 32.

Figure 23:
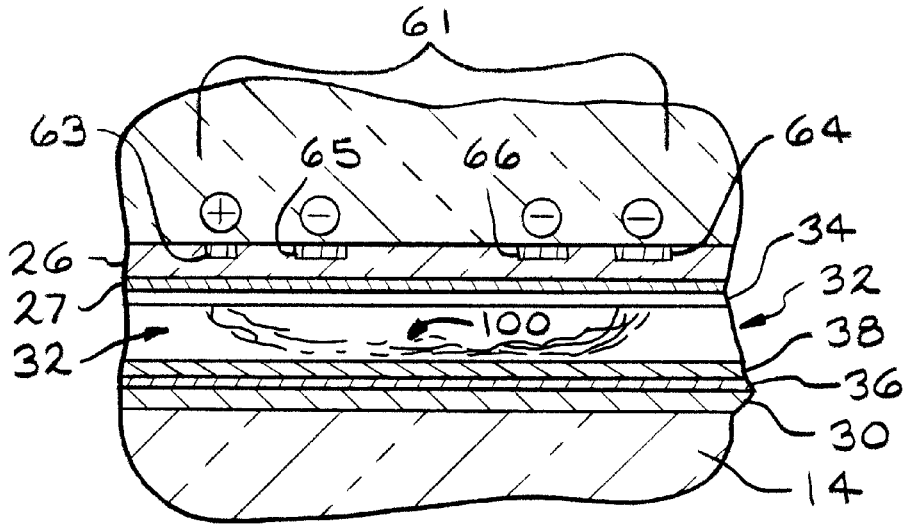
FIG. 23 is a fourth step in the method shown in FIG. 20.
Figure 24:
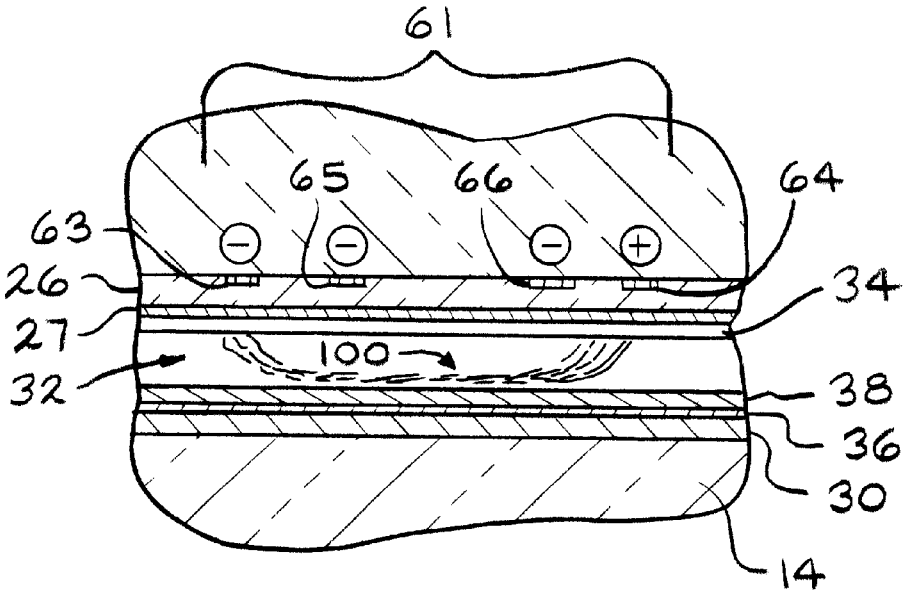
FIG. 24 is a fourth step in the method shown in FIGS. 10 through 15.
Figure 25:
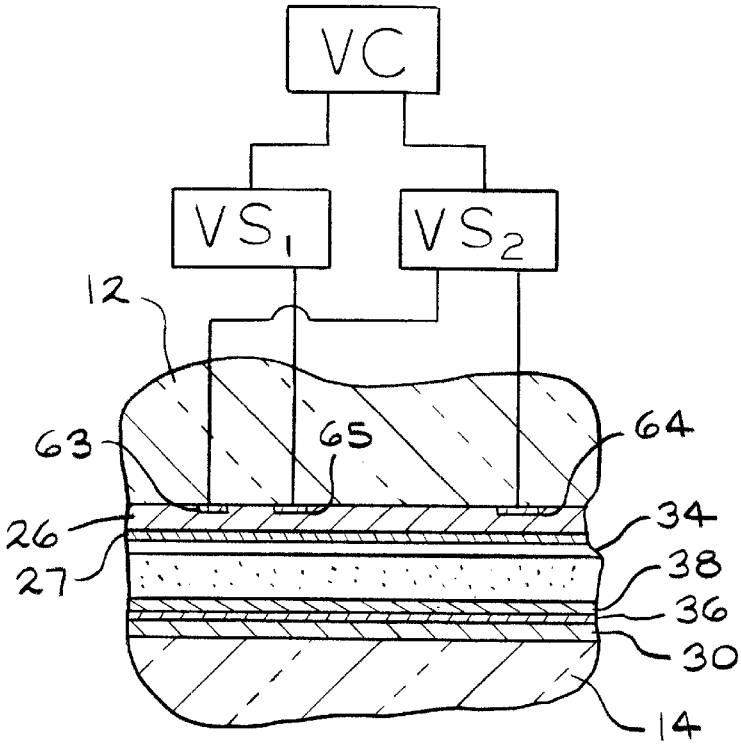
FIG. 25 is a schematic diagram illustrating voltages supplied to the panel shown in FIGS. 10 through 15.
Figure 27:
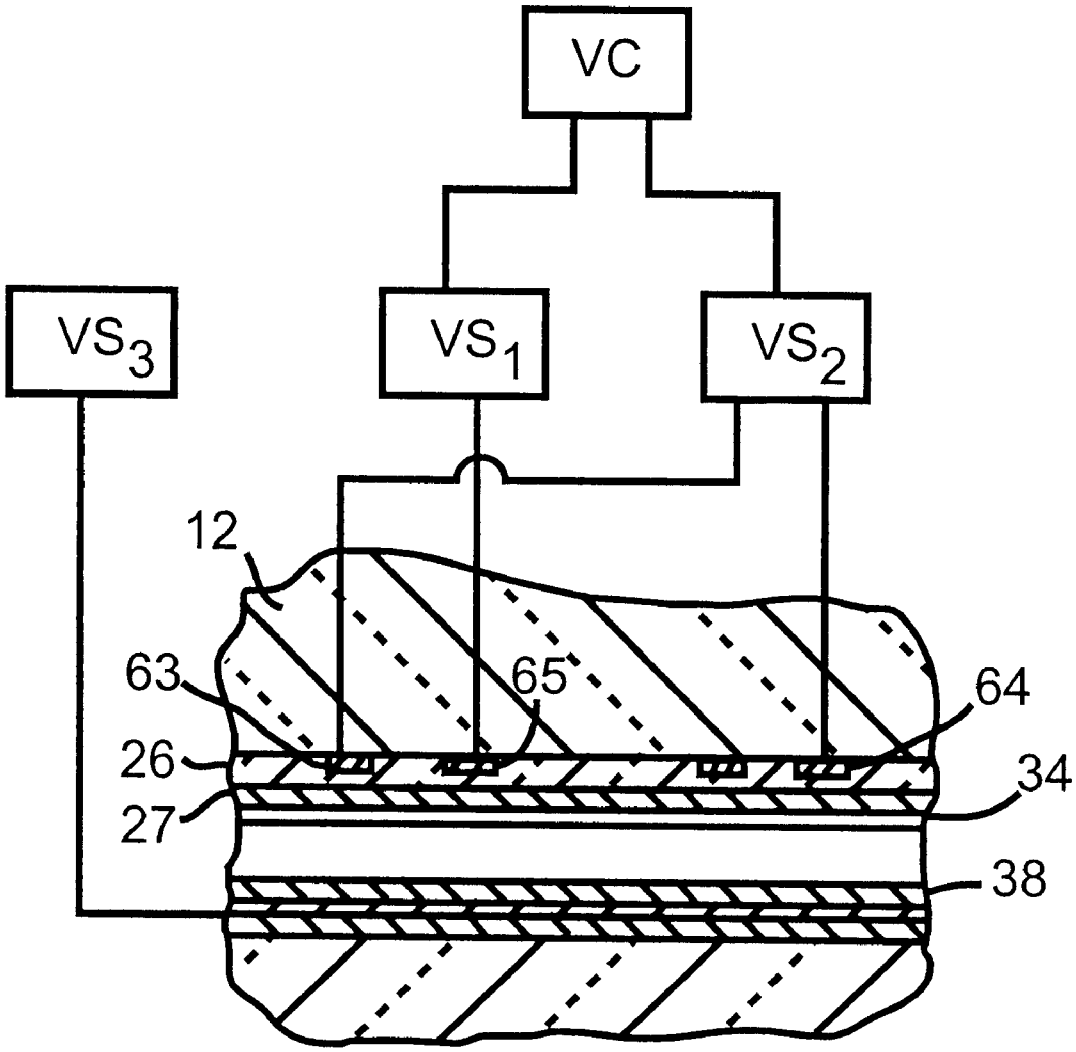
FIG. 27 is another schematic diagram illustrating voltages supplied to the panel shown in FIGS. 16 through 19.

It will be appreciated from the above description, that the PDP can be built with only one auxiliary electrode 65, as shown in FIGS. 25 and 27. However, it is contemplated that the second auxiliary electrode 66 can be used as illustrated in FIG. 23. A variable voltage is applied to both auxiliary electrodes 65 and 66 to control the depth of the discharge 100 within the channel 32. In FIG. 23, a negative voltage is applied to the first and second auxiliary electrodes 65 and 66. With both auxiliary electrodes 65 and 66 negative, the both ends of the discharge 100 are urged deeper into the channel 32. With the entire length of the discharge 100 pushed deeper into the channel 32, the incident area of UV upon the phosphor material 38 is further increased. FIG. 24 illustrates a similar situation applied to the method illustrated in FIGS. 10 through 15.

While the preferred embodiment of the operation of the plasma display panel has been illustrated and described above, the invention also contemplates alternate methods of operation. Thus, the voltages may be applied simultaneously to the auxiliary and sustaining electrodes (not shown). Because of the spacing between the electrodes, the discharge will initiate between the auxiliary and the adjacent sustaining electrode and subsequently extend to the other sustaining electrode. Alternately, the voltages may be first applied to the sustaining electrodes and then subsequently to the auxiliary electrode (not shown). Again, because of the spacing between the electrodes, the discharge will initiate between the auxiliary and the adjacent sustaining electrode and subsequently extend to the other sustaining electrode.

A schematic of the electrical connections used with the example shown in FIGS. 10 through 15 is shown in FIG. 25, where components which are the same as shown in the above figures have the same numerical identifiers. It will be noted that the plasma display panel shown in FIG. 25 has only one auxiliary electrode, which is adjacent to the left sustaining electrode 63. A first voltage supply, $VS_1$, is connected to the auxiliary electrode 65. A second voltage supply, $VS_2$, is connected across the left and right sustaining electrodes 63 and 64. A conventional voltage control device, VC, is connected to the voltage supplies $VS_1$ and $VS_2$ and operative to selectively actuate the voltage supplies as described above.

Figure 26:
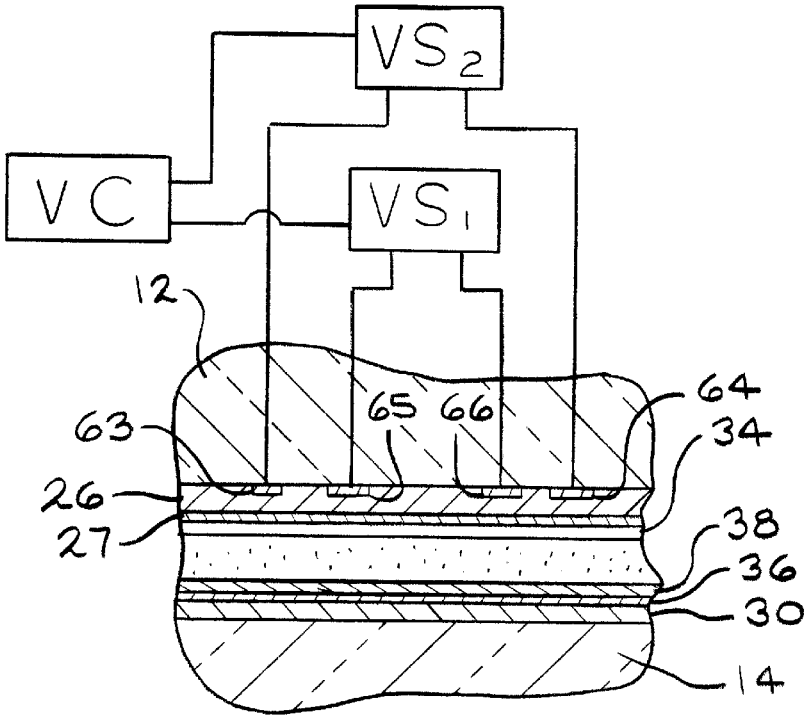
FIG. 26 is an alternate embodiment of the schematic diagram shown in FIG. 25.

In FIG. 26, a second auxiliary electrode 66 is included and connected to the first voltage supply $VS_1$. The first voltage supply $VS_1$ can be operated in two manners. As described above, the second auxiliary electrode 66 can be energized after the discharge is established and cooperate with the first auxiliary electrode to control the depth to which the discharge 100 extends into the channel 32. In this case, it is contemplated that an electronic switch (not shown) controlled by the voltage control device VC would be included in the first voltage supply $VS_1$. Alternately, as also described above, the first voltage source $VS_1$ could apply an auxiliary voltage to both of auxiliary electrodes 65 and 66 to initiate the discharge.

A second alternate embodiment which corresponds to FIGS. 16 through 19 is illustrated in FIG. 27. As shown in FIG. 27, there are three voltage supplies. A third voltage supply, $VS_3$, is connected to an opposite address electrode 36 which is formed upon the bottom substrate 14 and is perpendicular to the sustaining electrodes 63 and 64. The other two voltage supplies, $VS_1$ and $VS_2$, are connected as shown in FIG. 25. Additionally, the voltage control device VC also is connected to the third voltage supply $VS_3$.

While not discussed above, it is also contemplated that voltages be applied to the address electrodes 36 to form images on the face of the panel. Depending upon the polarity of the voltages applied to the address electrodes 36 relative to the sustaining electrode voltages, the address electrode voltages will either enhance or inhibit the discharge from forming between the sustaining electrodes.

The inventors have constructed such PDP devices and tested the efficiency with various waveforms and voltage amplitudes and measured efficiencies significantly greater than present commercially available plasma display panels. Although a higher voltage is required for the sustaining electrode pair, it can be made independent of addressing, promising innovative and economical circuit design.

Figure 28:
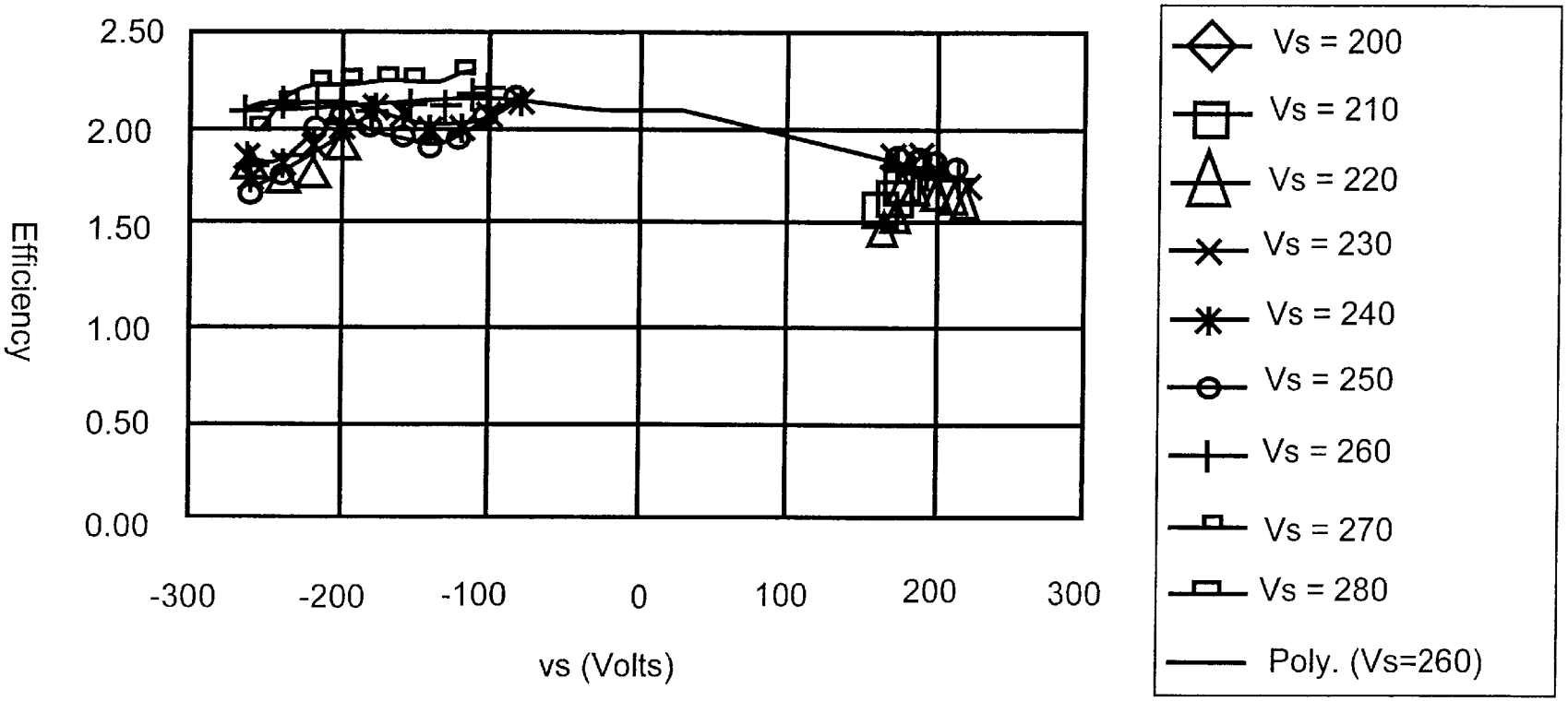
FIG. 28 is a graph illustrating the efficiency of panels built in accordance with the invention.

The inventors have been able to modify the PDP sustaining discharge structure by cell geometry and control of electric fields to significantly improve the luminous efficiency relative to conventional PDP design. Present commercial devices typically range between 1 to 1.2 lumens per Watt and the inventors have measured greater than 2 lumens per Watt for plasma display panels utilizing the invention. For large area PDP this promises to be a practical method to apply toward a truly competitive large area display screen for HDTV and other large screen applications. Typical results which have been achieved by the inventors are illustrated by the curves shown in FIG. 28. In FIG. 28, the horizontal axis represents the voltage $VS_1$ applied to the auxiliary electrode while the vertical axis represents display panel efficiency in lumens emitted per watt of power supplied to the panel. The data points on the graph correspond to the values for sustaining voltages, $VS_2$, shown adjacent to the graph. The curve labeled "poly" is based upon a polynomial fit to the data points obtained for a sustaining voltage of 260 volts. As shown in the figure, the efficiency is a function of the voltage applied between the sustaining electrodes. As can be readily seen in the middle of the graph, there exists a region where the magnitude of the voltage applied to the auxiliary electrode is quite low yet the panel efficiency is maintained high for most values of voltage applied to the sustaining electrodes. For example, when $VS_1$ is −100 volts, the output of the panel exceeds 2 lumens/watt, which is a significant increase over current conventional plasma discharge panels.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A plasma flat-panel display comprising:

a first transparent substrate;

at least one pair of parallel sustaining electrodes deposited upon said first substrate;

a least one auxiliary electrode deposited upon said first substrate parallel to said sustaining electrodes;

a layer formed from a dielectric material covering said sustaining and auxiliary electrodes;

a second substrate which is hermetically sealed to said first substrate, said second substrate having a plurality of micro-voids formed in a surface thereof which is adjacent to said first substrate, said micro-voids cooperating with said first substrate to define a plurality of sub-pixels;

a gas filling said micro-voids;

a plurality of address electrodes incorporated within said second substrate, each of said address electrodes corresponding to one of said sub-pixels;

a first voltage supply connected to said auxiliary electrode, said first voltage supply selectively operative to apply a first voltage to said auxiliary electrode; and a second voltage supply connected to said sustaining electrodes, said second voltage supply selectively operative to apply a second voltage to said sustaining electrodes, said second voltage being greater than said first voltage.

2. The plasma flat-panel display according to claim 1 wherein said first voltage initiates a discharge between said auxiliary electrode and one of said sustaining electrodes and further wherein said second voltage causes said discharge to extend to the other of said sustaining electrodes.

3. The plasma flat-panel display according to claim 2 further including a voltage supply control device connected to said first and second voltage supplies, said voltage control device operable to cause said second voltage supply to apply said second voltage to said sustaining electrodes after said first voltage is applied between said auxiliary electrode and said sustaining electrode.

4. The plasma flat-panel display according to claim 2 further including a voltage supply control device connected to said first and second voltage supplies, said voltage control device operable to cause said second voltage supply to apply said second voltage to said sustaining electrodes simultaneously with the application of said first voltage between said auxiliary electrode and said sustaining electrode.

5. The plasma flat-panel display according to claim 2 further including a voltage supply control device connected to said first and second voltage supplies, said voltage control device operable to cause said second voltage supply to apply said second voltage to said sustaining electrodes before said first voltage is applied between said auxiliary electrode and said sustaining electrode.

6. The plasma flat-panel display according to claim 2 wherein the voltage applied to said auxiliary electrode is subsequently changed to control the depth of said discharge within a corresponding one of said micro-voids.

7. The plasma flat-panel display according to claim 6 wherein said voltage applied to said auxiliary electrode is reversed to urge said discharge deep into said corresponding one of said micro-voids, whereby the illumination of the associated sub-pixel is enhanced.

8. The plasma flat-panel display according to claim 6 further including a second auxiliary electrode, said second auxiliary electrode having a voltage applied thereto to further control the depth of said discharge within a corresponding one of said micro-voids.

9. The plasma flat-panel display according to claim 1 including a pair of auxiliary electrodes positioned between said sustaining electrodes with said first voltage applied to said auxiliary electrodes to initiate a discharge between said auxiliary electrodes and said second voltage applied to said sustaining electrodes to extend said discharge between said sustaining electrodes.

10. The plasma flat-panel display according to claim 9 further including a voltage supply control device connected to said first and second voltage supplies, said voltage control device operable to cause said second voltage supply to apply said second voltage to said sustaining electrodes after said first voltage is applied to said auxiliary electrodes.

11. The plasma flat-panel display according to claim 9 further including a voltage supply control device connected to said first and second voltage supplies, said voltage control device operable to cause said second voltage supply to apply said second voltage to said sustaining electrodes simultaneously with the application of said first voltage to said auxiliary electrodes.

12. The plasma flat-panel display according to claim 9 further including a voltage supply control device connected to said first and second voltage supplies, said voltage control device operable to cause said second voltage supply to apply said second voltage to said sustaining electrodes before said first voltage is applied to said auxiliary electrodes.

13. The plasma flat-panel display according to claim 9 wherein the voltage applied to said auxiliary electrodes is subsequently changed to urge said control the depth to which the discharge extends into a corresponding one of said micro-voids.

14. The plasma flat-panel display comprising:

a first transparent substrate;

at least one pair of parallel sustaining electrodes deposited upon said first substrate;

a least one auxiliary electrode deposited upon said first substrate parallel to said sustaining electrodes;

a layer formed from a dielectric material covering said sustaining and auxiliary electrodes;

a second substrate which is hermetically sealed to said first substrate, said second substrate having a plurality of micro-voids formed in a surface thereof which is adjacent to said first substrate, said micro-voids cooperating with said first substrate to define a plurality of sub-pixels;

a gas filling said micro-voids;

a plurality of address electrodes incorporated within said second substrate, each of said address electrodes corresponding to one of said sub-pixels;

a first voltage supply connected between said one of said sustaining electrodes and one of said address electrodes, said first voltage supply selectively operative to apply a first voltage to said address electrode, whereby a discharge is initiated between said sustaining electrode and said address electrode;

a second voltage supply connected to said auxiliary electrode, said second voltage supply selectively operative to apply a second voltage to said auxiliary electrode, whereby said discharge is redirected toward said auxiliary electrode; and a third voltage supply connected to said sustaining electrodes, said third voltage supply selectively operative to apply a third voltage to said sustaining electrodes, said third voltage being greater than said second voltage, whereby said discharge is extended to the other of said sustaining electrodes.

15. The plasma flat-panel display according to claim 14 wherein said voltages establish a discharge between said sustaining electrodes and further wherein the voltage applied to said auxiliary electrode is subsequently changed to control the depth of said discharge into a corresponding one of said micro-voids.

16. The plasma flat-panel display according to claim 15 further including a voltage supply control device connected to said voltage supplies, said voltage control device operable to cause said second voltage supplies to sequentially apply voltages to associated electrodes to establish a discharge between said sustaining electrodes.

17. The plasma flat-panel display according to claim 1 further including an electron emissive surface layer covering said dielectric layer.

18. The plasma flat-panel display according to claim 17 wherein said electron emissive layer is formed from a first electron emissive material having a first gamma and a second electron emissive material having a second gamma, said first gamma being greater than said second gamma, with said first electron emissive material being adjacent to said sustaining electrodes and said second electron emissive material being adjacent to said auxiliary electrode, such that at least one of said sustaining electrodes will- preferentially function as a cathode relative to said auxiliary electrode.

19. The plasma flat-panel display according to claim 17 further including a phosphor material deposited within each micro-void and associated with said address electrodes.

20. The plasma flat display panel according to claim 19 wherein said pair of parallel sustaining electrodes is a first pair of sustaining electrodes and further wherein a second pair of parallel sustaining electrodes is deposited upon said first substrate parallel to said first pair of sustaining electrodes with said auxiliary electrode disposed between said first and second pair of sustaining electrodes.

21. The plasma flat display panel according to claim 19 wherein said auxiliary electrode is a first auxiliary electrode and further wherein a second auxiliary electrode is deposited upon said first substrate parallel to said sustaining electrode, said first and second auxiliary electrodes each having a width and being disposed between said sustaining electrodes with said auxiliary electrodes separated by a distance which is greater than said width of said auxiliary electrodes.

22. The plasma flat display panel according to claim 21 wherein said first and second auxiliary electrodes are centered between said sustaining electrodes.

23. The plasma flat-panel display according to claim 22 wherein the spacing of said auxiliary electrodes is within the range of 100 to 400 microns.

24. The plasma flat display panel according to claim 21 wherein said first auxiliary electrode is adjacent to one of said sustaining electrodes and said second auxiliary electrode is adjacent to the other of said sustaining electrodes.

25. The plasma flat-panel display according to claim 19 further including a layer of insulating film deposited upon said surface of said electron emissive layer and at least one electrically conductive surface pad located upon the surface of said insulating film in association with a corresponding sustaining electrode.

26. The method of operating a plasma flat-panel display comprising the steps of:

(a) providing a display including a first transparent substrate having at least one pair of parallel sustaining electrodes deposited thereupon and at least one auxiliary electrode deposited thereupon parallel to the sustaining electrodes, a layer formed from a dielectric material covering the sustaining and auxiliary electrodes, a second substrate which is hermetically sealed to the first substrate, the second substrate having a plurality of micro-voids formed in a surface thereof which is adjacent to the first substrate, the micro-voids generally perpendicular to the sustaining and auxiliary electrodes and cooperating with the first substrate to define a plurality of sub-pixels, a gas filling the micro-voids; and a plurality of address electrodes incorporated within the second substrate, each of the address electrodes corresponding to one of the sub-pixels;

(b) applying a first voltage to the auxiliary electrode of sufficient magnitude to inject a charge of electrons between the auxiliary electrode and one of the associated sustaining electrodes; and (c) applying a second voltage, which is greater than the first voltage, to the sustaining electrodes to cause a discharge between the sustaining electrodes.

27. The method according to claim 26 wherein the display further includes an electron emissive surface layer covering the dielectric layer, the electron emissive layer being formed from a first electron emissive material having a first gamma and a second electron emissive material having a second gamma, the first gamma being greater than the second gamma, with the first electron emissive material being adjacent to the sustaining electrodes and the second electron emissive material being adjacent to the auxiliary electrode, such that at least one of the sustaining electrodes will preferentially function as a cathode relative to the auxiliary electrode.

28. The method according to claim 26 further including, subsequent to step (c), applying a third voltage to the address electrodes to control the discharge between the sustaining electrodes.

29. The method according to claim 28 wherein the first and second voltages are alternating voltages.

30. The method of operating a plasma flat-panel display comprising the steps of:

(a) providing a display including a first transparent substrate having at least one pair of parallel sustaining electrodes deposited thereupon and a pair of parallel auxiliary electrodes deposited thereupon between and parallel to the sustaining electrodes, a layer formed from a dielectric material covering the sustaining and auxiliary electrodes, a second substrate which is hermetically sealed to the first substrate, the second substrate having a plurality of micro-voids formed in a surface thereof which is adjacent to the first substrate, the micro-voids generally perpendicular to the sustaining and auxiliary electrodes and cooperating with the first substrate to define a plurality of sub-pixels, a gas filling the micro-voids; and a plurality of address electrodes incorporated within the second substrate, each of the address electrodes corresponding to one of the sub-pixels;

(b) applying a first voltage to the auxiliary electrodes of sufficient magnitude to inject a charge of electrons between the associated sustaining electrodes; and (c) applying a second voltage, which is greater than the first voltage, to the sustaining electrodes to cause a discharge between the sustaining electrodes.

31. The method according to claim 30 wherein the auxiliary electrodes are centered between the sustaining electrodes.

32. The method according to claim 30 wherein one of the pair of auxiliary electrodes is adjacent to one of the sustaining electrodes and the other of the pair of auxiliary electrodes is adjacent to the other of sustaining electrodes.

* * * * *